United States Patent [19]

Hildreth et al.

[11] 4,117,444

[45] Sep. 26, 1978

[54] HEARING AID VOLUME CONTROL

[75] Inventors: Bradrick Alan Hildreth, Covina; Donald Harrison Stephens, Running Springs, both of Calif.

[73] Assignee: Bourns, Inc., Riverside, Calif.

[21] Appl. No.: 815,877

[22] Filed: Jul. 14, 1977

[51] Int. Cl.[2] ..... H01C 10/50

[52] U.S. Cl. ..... 338/198; 338/164; 338/172; 338/184; 338/199; 338/200

[58] Field of Search ..... 338/198, 199, 200, 163, 338/164, 160, 172, 174, 184, 188, 190, 191

[56] References Cited

U.S. PATENT DOCUMENTS

| | | | |
|---|---|---|---|
| 2,857,496 | 10/1958 | Louis | 338/202 X |
| 2,909,749 | 10/1959 | Barden et al. | 338/163 |
| 3,629,780 | 12/1971 | Burcham | 338/198 |
| 3,760,324 | 9/1973 | Baldwin et al. | 338/174 |

*Primary Examiner*—C. L. Albritton
*Attorney, Agent, or Firm*—Paul H. Ware; William G. Becker

[57] ABSTRACT

A potentiometer and switch combination suitable for use as a hearing aid volume control. A control cap positioned over the potentiometer body is provided with an integral cam which performs the function of switch actuation. Positive seal is provided by an O-ring formed from a flexible, resilient material. The body of the potentiometer holds the control cap in place by means of heat stakes over a lip on the housing and a post having a chevron at its upper end which mates with a recess in the control cap. The cap is positioned by heat staking to press the stiffly flexible, resilient material of the O-ring into frictional sealing relation with an abutting member and thereby seal the interior of the potentiometer housing. The sealing arrangement also introduces a torque which opposes the rotation of the control cap, thus providing positional stability and positive operating feel. The switch includes conductive strips held by the body, one strip forming a first contact surface and another strip forming a spring detent and a second contact surface. Rotating the cap moves the cam so as to actuate the switch, and also causes the spring detent to snap so as to give the operator a positive switching feel.

7 Claims, 5 Drawing Figures

Fig. 1.
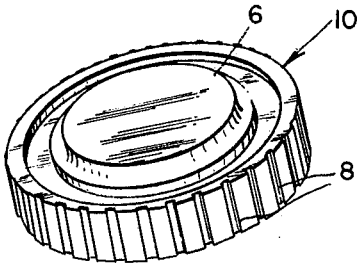
Fig. 2.
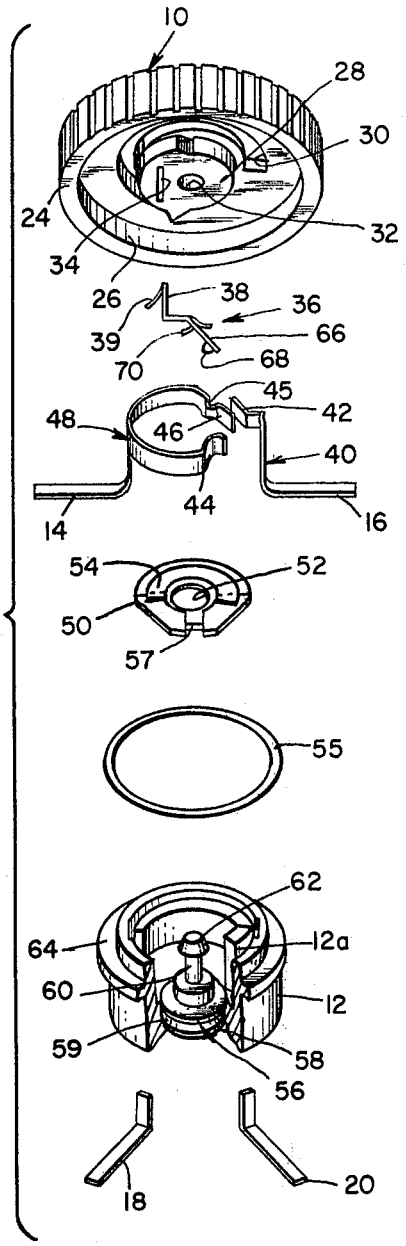
Fig. 3.
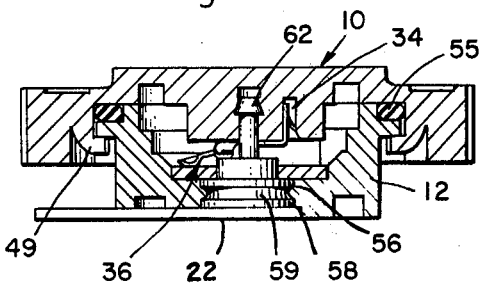
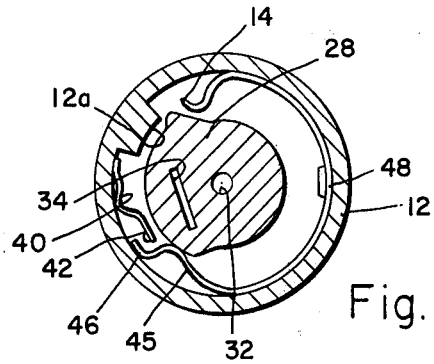
Fig. 4.
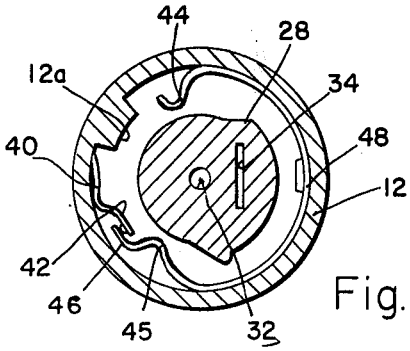
Fig. 5.

HEARING AID VOLUME CONTROL

BACKGROUND OF THE INVENTION

The subject invention relates generally to variable resistance devices and more particularly to such devices of the single-turn rotary type which are adaptable for use with hearing aids.

In a copending application of Bradrick Hildreth, George Wiley and Donald Stephens, Ser. No. 711,345, filed 8/4/76 for "Combined Rotary Potentiometer and Switch", to the same assignee, there is disclosed a hearing aid type device with a control cap sealed to a hollow body housing. The object of the present invention is to generally improve the construction and operation of such controls and particularly to provide a more secure environment seal, and a more positive switch actuation means in a fabrication requiring a minimum number of parts.

DESCRIPTION OF THE PRIOR ART

Hearing aid designs are known in which the device may be encapsulated into an ear mold and inserted into or behind the wearer's ear, or mounted on a pair of eyeglasses. In any case, it is desirable that the hearing aid be as small as possible so as to minimize its weight and visibility. It is also important that the hearing aid control be adequately sealed against the environment. In addition to the normal atmospheric substances such as dust and moisture, the control must operate in an environment which includes perspiration, body oils, and the like. Adequate sealing is made difficult, however, due to the requirement that the control be manually adjustable and accordingly, have a control knob or cap of operable size.

In addition to the variable resistance device for volume control, many hearing aid contrls incorporate a switch to turn the device off when it is not in use and thus save drain on the battery. It is desirable that the switch have a positive snap feel when it is actuated so that the user knows when the switch has been turned on or off. This snap feel should not, however, interfere with normal operation of the variable resistance adjustment portion of the device, which should have a smooth rotational friction requiring a torque for operation that gives the user a steady, positive feel as the resistance, and thus the volume, is adjusted. In addition, it is, of course, always advantageous to reduce the complexity and cost of control devices.

The basic types of hearing aid volume controls are wellknown. Many types have been developed and have been in use for many years. Most of these prior art devices have met special needs as presented by specific problems and have thus served narrow purposes. Some of these prior art devices have been described in the following listed patents that were brought to the attention of the applicant through a novelty search conducted in the United States Patent and Trademark Office:

1. U.S. Pat. No. Re. 19,605 — J. A. Flanzer et al — Variable Resistor.
2. U.S. Pat. No. 3,237,140 — W. A. Barden et al — Variable Resistance Control.
3. U.S. Pat. No. 3,760,324 — Kenneth B. Baldwin et al — Single-Turn Potentiometer.
4. U.S. Pat. No. 2,857,496 — A. S. Louis — Sealed Potentiometers.

5. U.S. Pat. No. 3,208,024 — H. B. Enos et al — Potentiometer Construction.
6. U.S. Pat. No. 3,197,727 — W. D. Hulbert — Potentiometer.

Many prior art systems and devices have had defects which have made them inappropriate and sometimes uncomfortable. In some cases they have been difficult to operate.

It would thus be a great advantage to the art to provide a hearing aid volume control that was small enough to be inconspicuous yet large enough to be easily operated. Another great advantage would be to provide such a volume control that incorporated a positive operating feel in the mechanism of a switch and the variable resistance device. A further desirable advantage would be to provide such a device featuring also ease and simplicity or operation, and an economy of parts.

SUMMARY OF THE INVENTION

It is an object of the present invention to provide a hearing aid volume control incorporating the abovementioned advantages.

Another object is the provision of the hearing aid volume control with improved sealing so as to maintain the mechanism of the volume control itself impervious to the effects of its environment.

In the accomplishment of these and other objects, a variable resistance device is provided in which a cam, integrally molded with a control cap, operates a switch either on or off and causes the movement of a wiper spring along an arcuate resistance element formed upon a nonconducting substrate. A sealing element in the form of an O-ring is pressed onto a sealing ledge of a hollow body portion by pressing the control cap thereonto. The hollow body portion of the device contains a post having a chevron that fits into a central aperture or recess formed in the switch actuating cam so as to deform the material of the cam into an interference fit. The hollow body portion is also held in mechanical contact with the control cap by means of crimping or staking the control cap which accepts the sealing ledge formed on the hollow body portion. Detents formed in the switch elements provide a positive snap feel when the switch is operated either on or off and the compressive forces prevailing between the control cap, the O-ring and the hollow body portion provide a torque resisting force, thus providing a positive feel to the operator when the position of the wiper spring is being changed and also providing positional stability under the effects of vibration.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings, wherein like reference characters refer to like parts throughout, and in which:

FIG. 1 is an isometric view of the control cap as contemplated by the invention;

FIG. 2 is an exploded isometric view of the device with a portion of the hollow body portion cut away so as to show details of the post;

FIG. 3 is an enlarged sectional view illustrating the compression of the sealing element and showing how the device is held together mechanically;

FIGS. 4 and 5 are bottom plan views of the device showing the switch actuating cam holding the switch in the open position and in the closed position, respectively.

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Referring to FIG. 1 with greater particularity, the control cap of the device is indicated generally by the numeral 10. Numeral 6 denotes a raised center portion and the numeral 8 denotes knurls formed in the control cap so as to facilitate operability.

In the exploded view shown in FIG. 2, the control cap is again denoted by the numeral 10. A switch actuating cam is denoted by the numeral 28 and a slot formed therein is shown as 34 while a central aperture or recess is denoted by the numeral 32. It is seen that the cap has a ledge 24 and an inner side wall 26 while the stop slot is denoted by numeral 30.

A wiper spring denoted generally by numeral 36 comprises a tang 38 that has a barb 39 which fits into the slot 34 of actuating cam 28. The wiper spring 36 also has a downward bent wiper spring 66 that has a dimple 68 on its underside for contacting a resistance element. Another part of the wiper element designed to maintain contact with central post 60 is denoted by numeral 70.

The switch in the embodiment shown is made up of two main elements; a flexible, resilient, metallic strip is denoted generally by the numeral 40, and has a first switch contact area 42 and a first switch terminal 16. The other switch element is a metallic blade spring denoted generally by the numeral 48 and is made up of a second switch contact area 46, a first positive feel detent 44, and a second positive feel detent 45. A second switch terminal is denoted by the numeral 14.

A nonconductive substrate 50 having a central aperture 52 and a positioning keyway notch 57 has formed upon its surface an arcuate resistance element 54. A sealing member, shown in the present embodiment as an O-ring, is denoted by the numeral 55.

A hollow body portion is denoted generally by the numeral 12. The hollow body portion 12 is shown as having a sealing ledge 64 and a bead 59. Potentiometer terminals are denoted by the numerals 18 and 20.

A central post is denoted by the numeral 60 and it is shown as being made up of a top chevron 62 and an intermediate ring portion 56 that has an annular bead retaining recess 58 into which the bead 59 of hollow body portion 12 fits. Chevron 62 forms an interference fit with central recess 32 of switch actuating cam 28.

Referring now to FIG. 3, it may be seen how the sealing ledge 64 is retained by the crimped area of the ledge 24 and how this retention causes compression of the sealing member 55. This view also shows how wiper spring 36 maintains contact with resistance element 54 and central body post 60. It may also be more easily seen that as the cap 10 is rotated, so also is rotated the switch actuating cam 28, thus causing rotation of wiper spring 36.

FIG. 4 shows switch actuating cam 28 as rotated so as to contact detent 45 and cause opening of the switch. It is seen that contact area 42 has been separated from contact area 46. FIG. 5 shows switch actuating cam 28 as having been rotated so as to relieve detent 45, thus allowing closure of the switch by completing the contact of switch area 42 with switch area 46.

Thus there has been described a variable resistance device suitable for use in a hearing aid that will accomplish all the objects as set forth in the specification. Great improvements in reliability, flexibility, ease of operation, and safety have been provided through the novel advantages of the invention.

It is pointed out that although the present invention has been shown and described with reference to particular embodiment, nevertheless various changes and modifications obvious to one skilled in the art to which the invention pertains are deemed to lie within the purview of the invention.

What is claimed and desired to be secured by Letters Patent of the United States is:

1. A variable resistance device comprising:
   - a hollow body portion having a sealing ledge;
   - a post situated in said hollow body portion having a chevron at one end thereof and an intermediate ring portion that provides an annular bead retaining recess;
   - a sealing member to fit about said sealing ledge;
   - a substrate having a central aperture to fit about said post and a positioning keyway notch and having an arcuate resistance element formed thereon;
   - switch means retained in said hollow body portion comprising a flexible, resilient, metallic strip having a first switch contact area and a first switch terminal, and a metallic blade spring having a second switch contact area and a second switch terminal and having first and second positive-feel detents;
   - wiper spring means for wiping said arcuate resistance element;
   - a control cap having a sealing surface that fits over said sealing ledge thereby compressing said sealing member so as to form an airtight seal;
   - means for constraining said sealing surface to fit over said sealing ledge;
   - a switch actuating cam formed integrally with said control cap and rotatable therewith so as to actuate said switch means and to position said wiper spring means.

2. The variable resistance device of claim 1, wherein said hollow body portion having a sealing ledge is formed of a stiffly flexible, resilient material.

3. The variable resistance device of claim 1, wherein said post is formed of a conductive metal.

4. The variable resistance device of claim 1, wherein said sealing member is an O-ring.

5. The device of claim 4, wherein said O-ring is formed of a stiffly flexible, resilient, compressible material.

6. The variable resistance device of claim 1, wherein said sealing surface is constrained to fit over said sealing ledge by means of staking.

7. The device of claim 6, wherein said sealing surface is constrained to fit over said sealing ledge by means of heat staking.

* * * * *